US006186814B1

(12) United States Patent
Matsushita

(10) Patent No.: US 6,186,814 B1
(45) Date of Patent: Feb. 13, 2001

(54) WATERTIGHT CONNECTOR

(75) Inventor: Yasuo Matsushita, Yokkaichi (JP)

(73) Assignee: Sumitomo Wiring Systems, Ltd. (JP)

( * ) Notice: Under 35 U.S.C. 154(b), the term of this patent shall be extended for 0 days.

(21) Appl. No.: 09/359,513

(22) Filed: Jul. 23, 1999

(30) Foreign Application Priority Data

Jul. 23, 1998 (JP) ..... 10-208322

(51) Int. Cl.[7] ..... H01R 13/52
(52) U.S. Cl. ..... 439/271
(58) Field of Search ..... 439/271, 272, 439/273, 274, 275, 587, 352, 358

(56) References Cited

U.S. PATENT DOCUMENTS

| | | | | |
|---|---|---|---|---|
| 5,292,258 | | 3/1994 | Sakurai | 439/352 |
| 5,484,301 | * | 1/1996 | Koumatsu et al. | 439/271 |
| 5,830,002 | | 11/1998 | Ito et al. | 439/358 |
| 5,879,179 | * | 3/1999 | Fukuda | 439/271 |
| 5,906,499 | * | 5/1999 | Sikora et al. | 439/271 |
| 6,045,383 | * | 4/2000 | Fujiwara | 439/271 |

FOREIGN PATENT DOCUMENTS 0 803 937 10/1997 (EP) .

* cited by examiner

*Primary Examiner*—Paula Bradley
*Assistant Examiner*—Tho D. Ta
(74) *Attorney, Agent, or Firm*—Anthony J. Casella; Gerald E. Hespos; Michael J. Pocro

(57) ABSTRACT

A watertight connector is provided with an inertial locking mechanism, housings of which can be connected while making an operator feel and notice the completion of a connecting operation. The inertial locking mechanism 17 has resistance arms 22 and contact ribs 15 and is provided between male and female housings 11 and 20. A front annular projection 28A of a waterproof ring 27 mounted on the female housing 11 is brought into contact with the leading end of a receptacle 12 of a male housing 20 at a timing when the resistance arms 22 and the contact ribs 15 are brought into contact with each other during a connecting operation of the housings 11, 20. Thus, a peak P3 of a connection resistance value of the waterproof ring 27 and a peak P4 of a connection resistance value of the inertial locking mechanism 17 are synchronized to generate a large connection resistance, and a large inertial force can be obtained when this large connection resistance disappears.

7 Claims, 9 Drawing Sheets

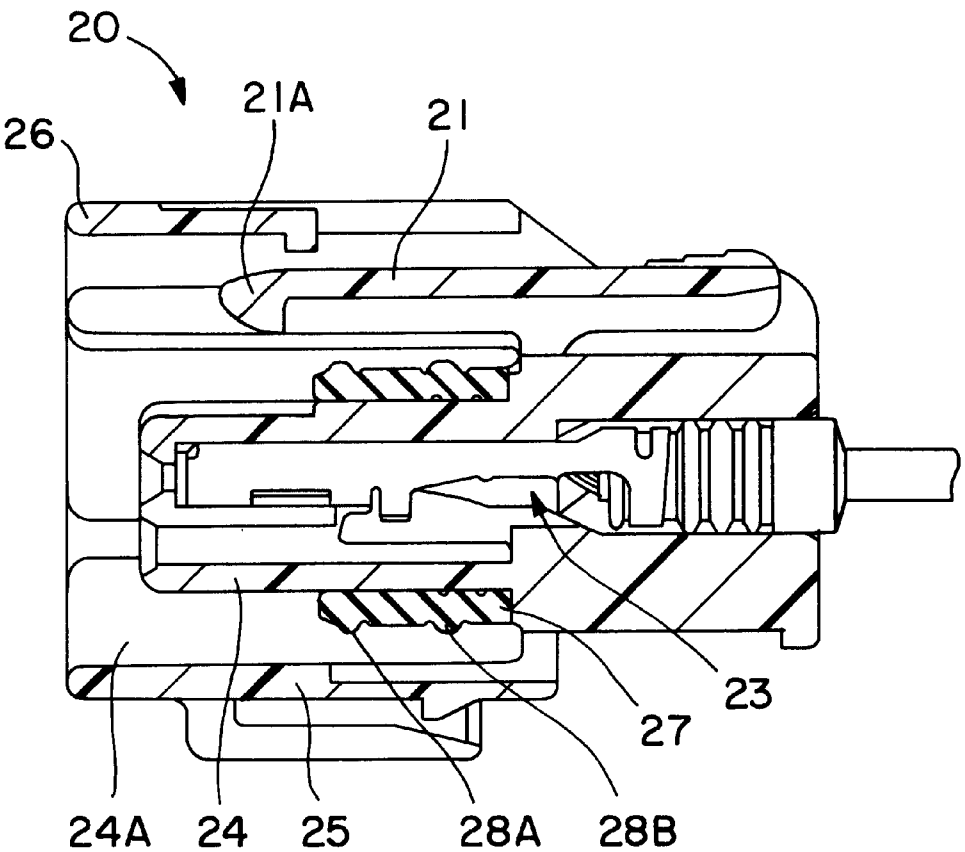
FIG. 2
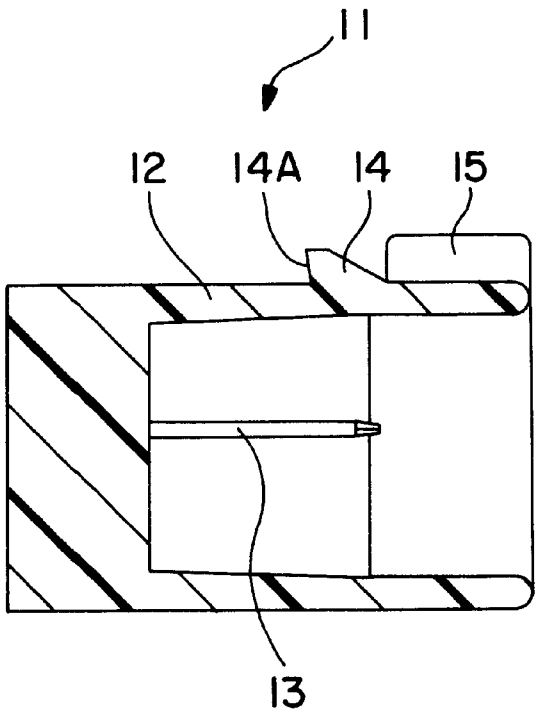

CONNECTOR CONNECTING CURVE

P3...PEAK P4...PEAK

CONNECTOR CONNECTING CURVE

P1...PEAK P2...PEAK

WATERTIGHT CONNECTOR

BACKGROUND OF THE INVENTION

1. Field of the Invention

The present invention relates to a watertight connector provided with an inertial locking mechanism.

2. Description of the Related Art

When a pair of connector housings of a watertight connector are connected with each other, an operator might mistakenly judge that the connection is completed when connection resistance of the entire connector increases. The increase of a connection resistance could be caused by a waterproof ring provided between the two connector housings, a connection resistance acting between terminals, and the like even though the connector housings are still being connected. An inertial locking mechanism is used in the prior art to prevent the connector housings from being left partly connected. The inertial locking mechanism includes a connection resistance generating means for temporarily generating a connection resistance larger than the connection resistances by the waterproof ring and by the terminal fittings during the connecting operation. The operation can feel a sudden decrease in connection resistance when the connecting operation overcomes the connection resistance generated by the connection resistance generating means and passes a connection resistance generating area. The two connector housings then can be connected properly by a force exerted to pass the generating area, i.e. an inertial force.

A prior art watertight connector provided with such an inertial locking mechanism was developed by the applicant of the present application, and is shown in FIG. 9. The prior art connector includes a pair of resistance arms 3 provided in a female housing 1 and a pair of contact ribs 5 provided in a male housing 4. The resistance arms 3 and the contact ribs 5 are brought into contact with each other during the connection of the two housings 1, 4, thereby generating a large connection resistance. When the housings 1, 4 are pushed in connection directions with a force equal to or larger than a specified value, the resistance arms 3 and the contact ribs 5 suddenly are disengaged from each other, and the housings 1, 4 reach their connection completion position by inertial force and are locked into each other by a lock arm 2. Further, a waterproof ring 8 is mounted in the female housing 1. A pair of annular projections 6 formed on the outer circumferential surface of the waterproof ring 8 are to be pushed and deformed by a receptacle 7 of the male housing 4.

FIG. 10 shows changes in connection resistance values of the respective elements as the housings 1, 4 of the watertight connector are connected. Here, the connection resistance value of the watertight ring 8 is confirmed to change in such a manner that peaks P1 (see FIG. 10) are reached when the leading end of the receptacle 7 move over the respective annular projections 6. In this watertight connector, the peaks P1 of the connection resistance value of the annular projections 6 are reached after a peak P2 of the connection resistance value of the inertial locking mechanism comprised of the resistance arms 3 and the contact ribs 5 is reached. Accordingly, a difference between the resistance value during the restriction of the connecting operation by the inertial locking mechanism and that after the cancellation of the restriction cannot be made clear and, therefore, the operator cannot sufficiently feel and notice that the connection has been completed.

Published European Application No. 0 803 937 discloses a watertight connector similar to the above one. This watertight connector has a waterproof ring having three annular projections formed thereon, but still has a problem similar to the above.

In view of the above problems, an object of the present invention is to provide a watertight connector with an inertial locking mechanism, housings of which can be connected while making an operator feel and notice the completion of a connecting operation.

SUMMARY OF THE INVENTION

According to the invention, there is provided a watertight connector, comprising at least two connector housings connectable with each other. The connector also has an inertial locking mechanism respectively provided between two connector housings for restricting a connecting operation while the connector housings are being connected. A waterproof ring is provided in one of the connector housings and has at least one projection formed on the outer circumferential surface thereof so that the projection is pushed and deformed by a corresponding surface of the other connector housing at least in the connection completion position. The waterproof ring holds the connector housings substantially watertight in the connection completion position. A connection resistance by the waterproof ring which acts during the connecting operation of the connector housings reaches its peak value when the leading end of the other connector housing moves over the projection and thereafter decreases. The projection is arranged on the waterproof ring along a connection direction to be brought into contact with the leading end of the other connector housing when the inertial locking mechanism is brought to its restricting state. Thus the peak of the connection resistance value of the waterproof ring and a peak of a connection resistance value of the inertial locking mechanism are reached at substantially the same timing or stroke of one connector housing into the other during the connecting operation of the connector housings.

According to a preferred embodiment of the invention, the inertial locking mechanism substantially cancels the restriction when the connector housings are pushed to be further connected with a force equal to or exceeding a specified value, and brings the connector housings to their connection completion position by its inertial force to lock them into each other.

Preferably, the projection provided on the waterproof ring is an annular projection, which is pushed and deformed by a circumferential surface as the corresponding surface of the other connector housing in the connection completion position to substantially hold the connector housings watertight.

According to a further preferred embodiment of the invention there is provided a watertight connector, comprising two connector housings to be connectable with each other. An inertial locking mechanism is provided between the two connector housings for restricting a connecting operation while the connector housings are being connected, cancelling the restriction when the connector housings are pushed to be further connected with a force equal to or exceeding a specified value, and bringing the connector housings to their connection completion position by its inertial force to lock them into each other. A waterproof ring is provided in one of the connector housings and has an annular projection formed on the outer circumferential surface thereof so that the annular projection is pushed and deformed by a circumferential surface of the other connector housing in the connection completion position to hold the connector housings watertight. A connection resistance by the waterproof ring which acts during the connecting operation of the connector housings reaches its peak value when the leading end of the other connector housing moves over the annular projection and thereafter decreases. Additionally the annular projection is arranged to be brought into contact with the leading end of the other connector housing when the inertial locking mechanism is brought to its restricting state. Thus the peak of the connection resistance value of the waterproof ring and a peak of a connection resistance value of the inertial locking mechanism are reached at the same timing during the connecting operation of the connector housings.

Accordingly, the annular projection of the waterproof ring is brought or bringable into contact with the leading end of the other connector housing when the inertial locking mechanism is brought to its restricting state during the connecting operation of the connector housing. Therefore, the peak of the connector resistance value of the waterproof ring and that of the inertial locking mechanism are reached at substantially the same timing, and a resulting large connection resistance or force restricts the connecting operation of the connector housings. When the connector housings are pushed to each other with a force equal to or exceeding the above described connection resistance, the restriction by the inertial locking mechanism is suddenly cancelled or substantially reduced and the connector housings are fully connected by the inertial force. At this time, since the connection resistance values of the waterproof ring and the inertial locking mechanism suddenly decrease after passing the respective peaks, a difference between the connection resistance value during the connection restriction by the inertial locking mechanism and the one after the cancellation of the connection restriction is made clearer. As a result, an operator can connect the connector housings while sufficiently feeling and noticing a success in connecting them.

Preferably, the waterproof ring is provided with a plurality of annular projections, and one of the annular projections is so arranged as to be brought into contact with the leading end of the other connector housing when the inertial locking mechanism is brought to its restricting state. Accordingly, the plurality of annular projections are provided and the peak of the connector resistance value of one of these annular projections is reached at the same time as the peak of the connection resistance value of the inertial locking mechanism, so that the connection of the connector housings is restricted by a resulting large connection resistance. Therefore, a difference between the connection resistance value during the connection restriction and the one after the cancellation of the connection restriction is made clearer.

Further preferably, at least one terminal fitting is provided in the one connector housing and a corresponding number of mating terminal fittings is provided in the at least one other connector housing. The terminal fittings are arranged in the respective connector housings such that they are not connected when the inertial locking mechanism is brought to its restricting state.

Still further preferably, the inertial locking mechanism comprises at least one contact rib and at least one resistance arm projecting toward each other. The resistance arm is deflected in a deflection direction upon application of a pushing force being substantially higher than the sum of the respective values of the connection resistances of the waterproof ring and the inertial locking mechanism at their peaks.

Most preferably, the at least one resistance arm is provided with one or more protuberances having contact surfaces which come into contact with the corresponding rib. The contact surfaces are inclined at an angle preferably between 70° to 110, more preferably between 80° and 100°, most preferably approximate to a right angle with respect to the connection direction.

These and other objects, features and advantages of the present invention will become more apparent upon a reading of the following detailed description and accompanying drawings.

BRIEF DESCRIPTION OF THE DRAWINGS

FIG. 2 is a side view in section of the watertight connector.

DETAILED DESCRIPTION OF THE PREFERRED EMBODIMENT

Figure 1:
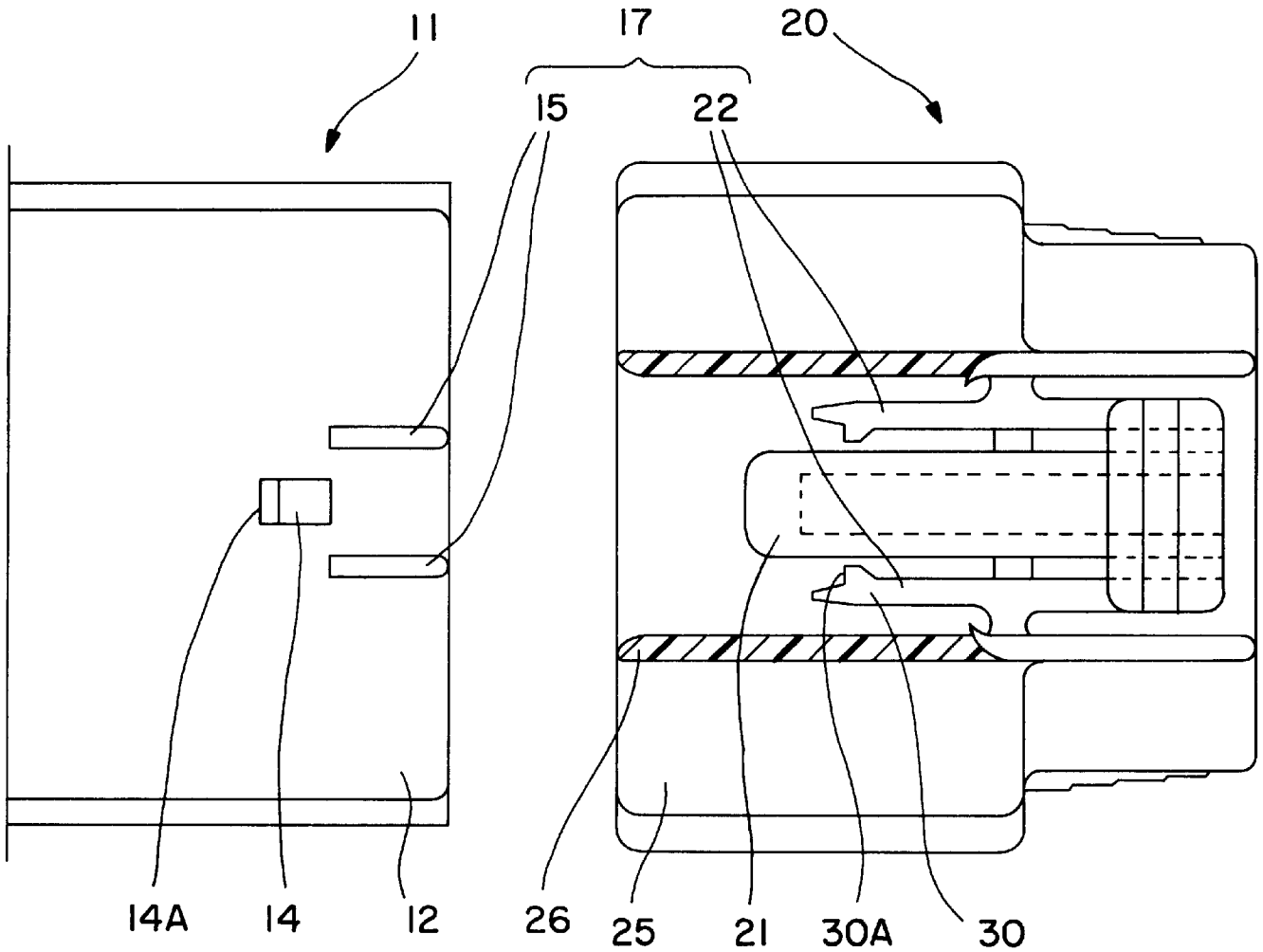
FIG. 1 is a plan view of a watertight connector according to one embodiment of the invention.

A watertight connector according to the invention is provided with male and female connector housings which are identified by the numeral 11 and 20 in FIGS. 1–8 and which are connectable with each other.

The male housing 11 is integrally or unitarily formed with a receptacle 12 projecting, for example, from a side wall of an electrical equipment, and at least one male tab 13 (see FIG. 2) projects preferably from the back wall of the receptacle 12. On a lateral, and preferably upper surface of the receptacle 12 (upper surface in FIG. 2), a lock projection 14 projects substantially in the middle with respect to the widthwise direction of the receptacle 12 and a pair of contact ribs or portions or projections 15 extend substantially parallel to each other in front of the locking projection 14.

On the other hand, the female housing 20 is constructed, as shown in FIG. 2, such that a substantially surrounding wall 25 surrounds a front half of a cavity 24 for accommodating at least one corresponding female terminal fitting 23. The receptacle 12 of the male housing 11 is at least partially fittable into a space 24A defined between the surrounding wall 25 and the cavity 24.

Figure 6:
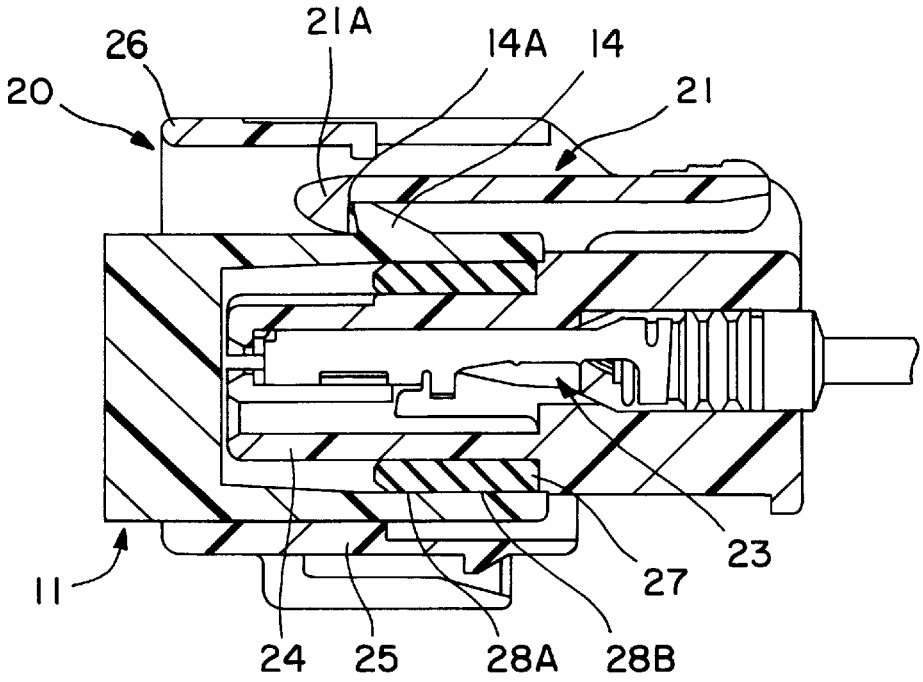
FIG. 6 is a side view in section of the male and female housings in the state of FIG. 5.
Figure 7:
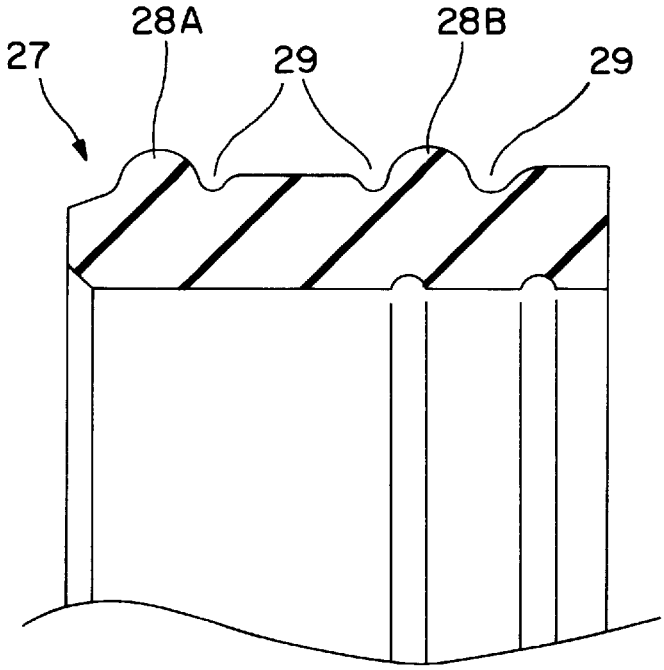
FIG. 7 is a side view in section of a waterproof ring.

A substantially middle part of the upper surface of the surround wall 25 bulges out, and a front part of a lock arm 21 is located at least partially inside this bulging portion 26. When the housings 11, 20 are connected, a locking projection 21A preferably provided at the leading end of the lock arm 21 cooperates or moves over the lock projection 14 as the lock arm 21 is inclined, and is engaged with a rear surface 14A of the lock projection 14 (FIG. 6).

Figure 3:
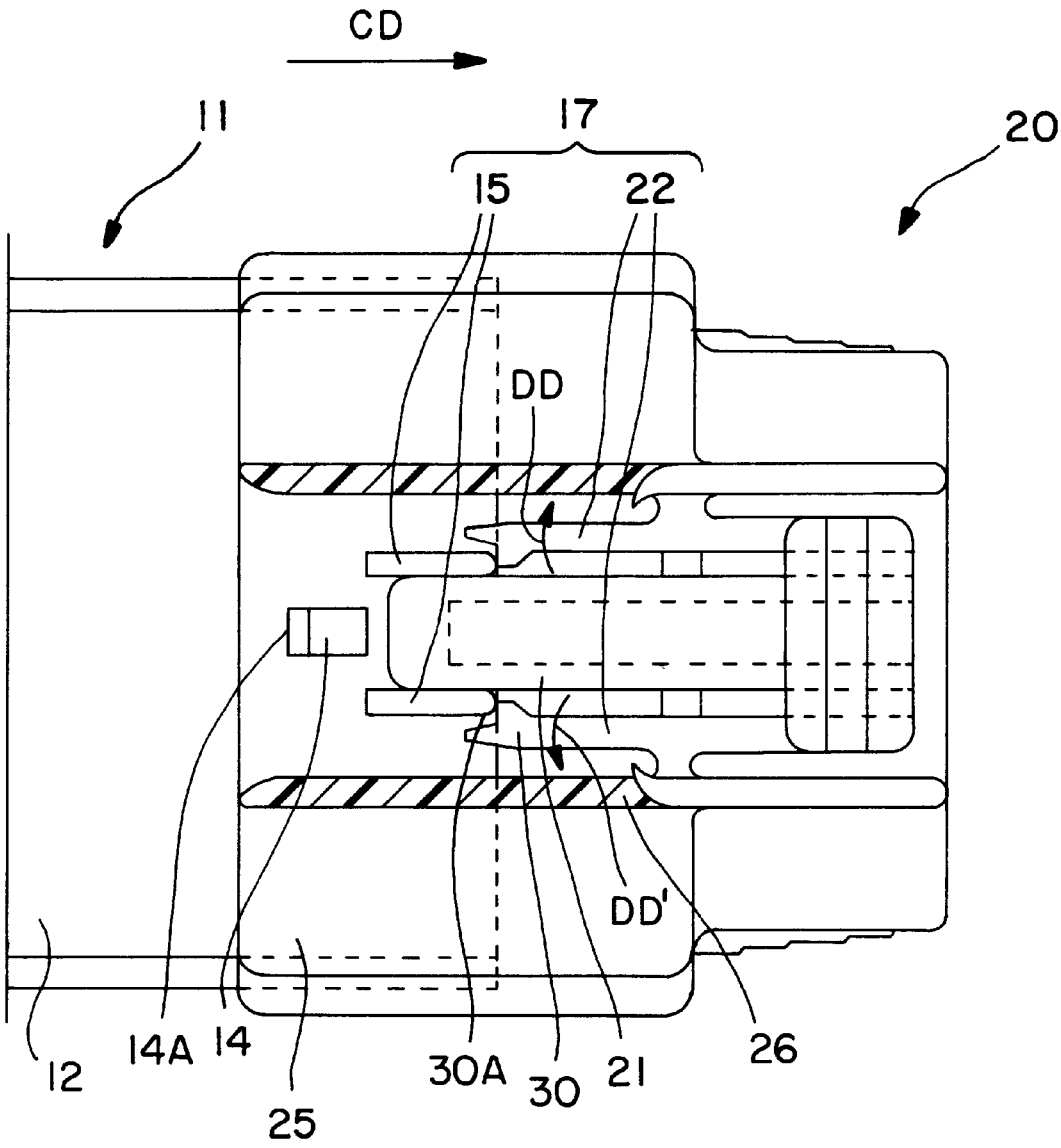
FIG. 3 is a plan view of male and female housings at an initial stage of a connecting operation.
Figure 4:
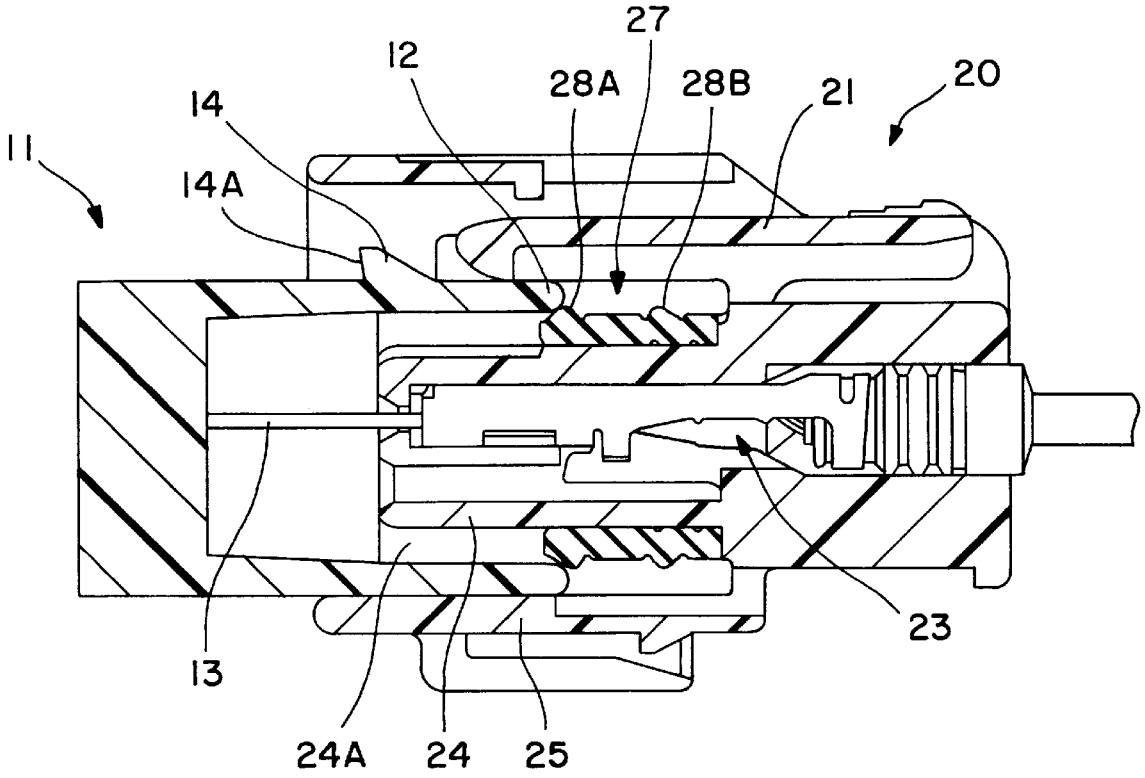
FIG. 4 is a side view in section of the male and female housings in the state of FIG. 3.
Figure 5:
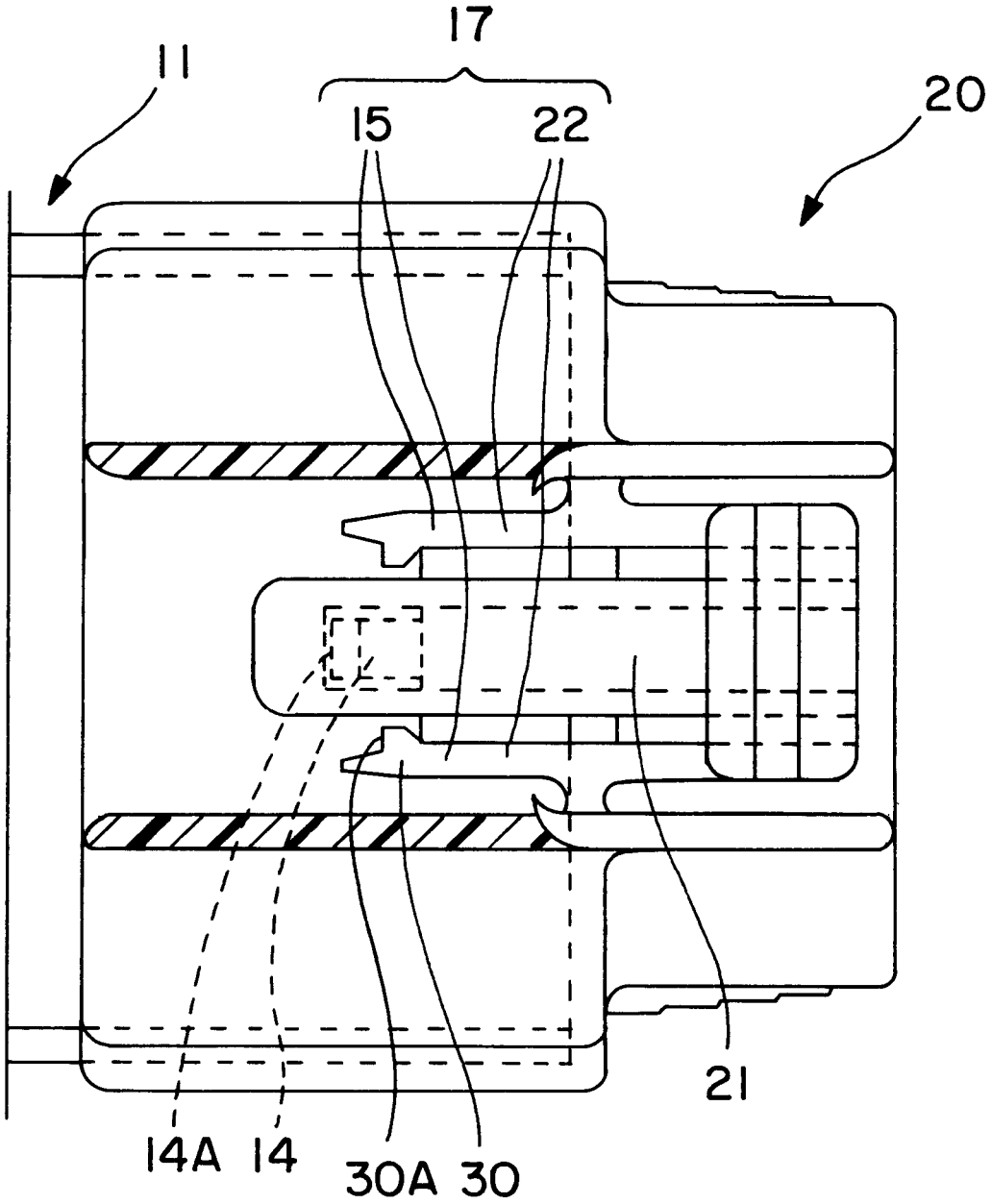
FIG. 5 is a plan view of the male and female housings at the completion of the connecting operation.
Figure 8:
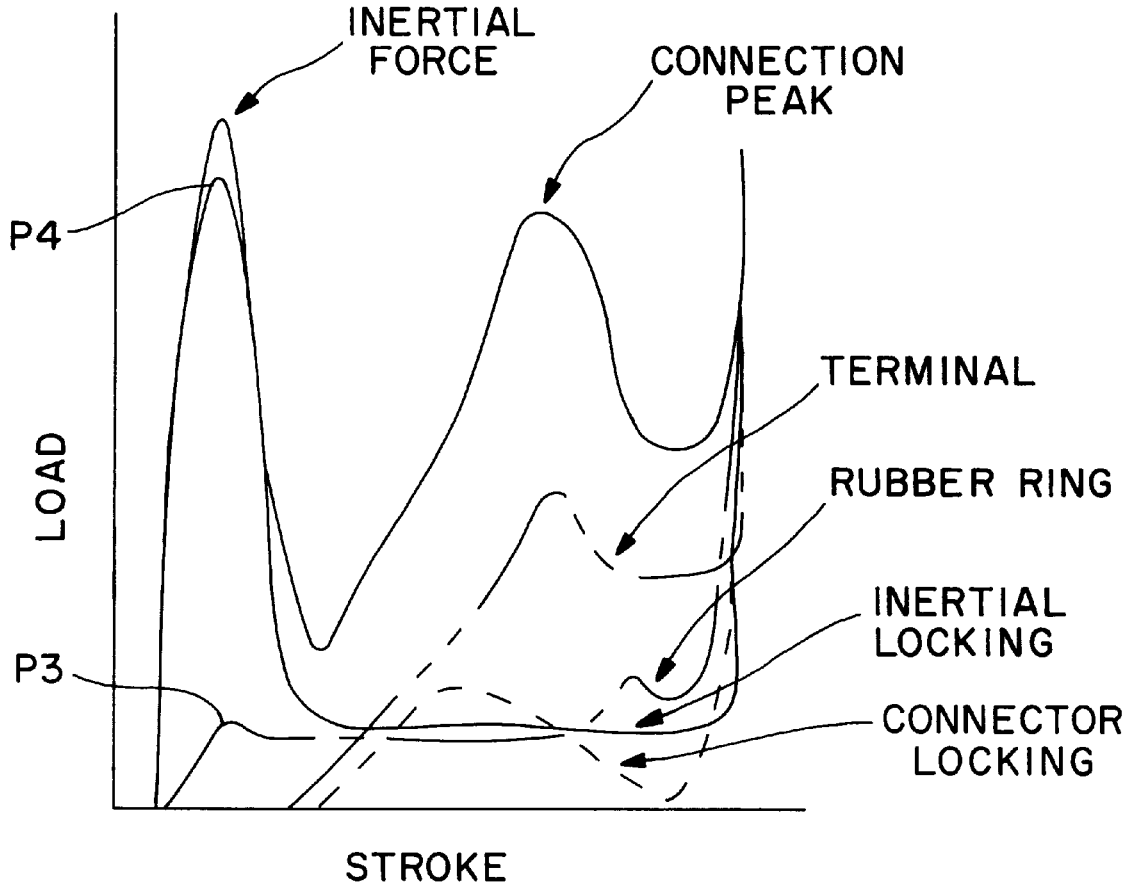
FIG. 8 is a graph showing changes in connection resistances.
Figure 9A:
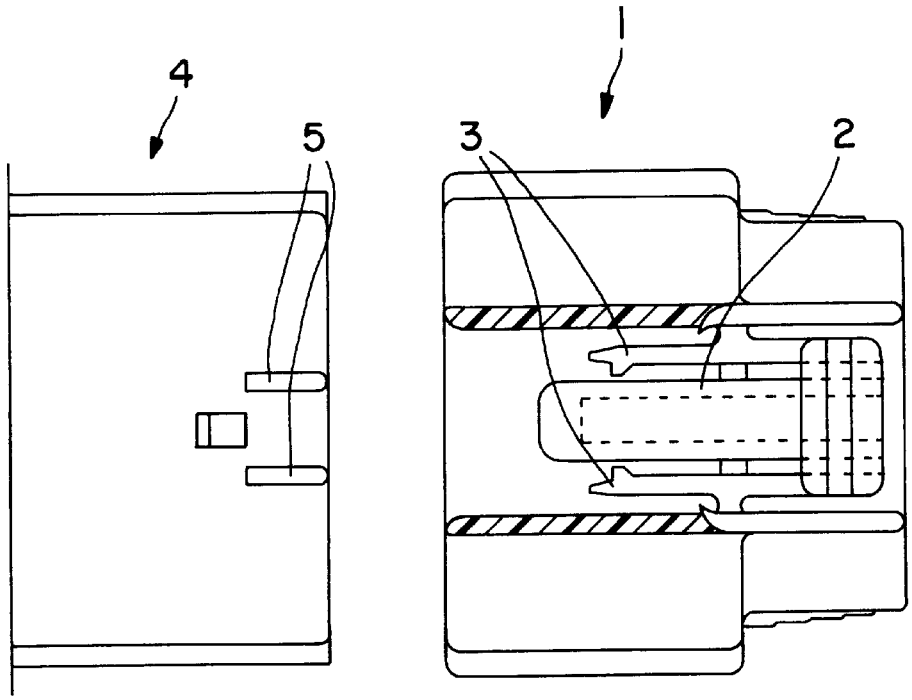
FIG. 9(A) PRIOR ART
FIG. 9(A) and FIG. 9(B) are a plan view and a side view in section of a prior art watertight connector, respectively.
Figure 9B:
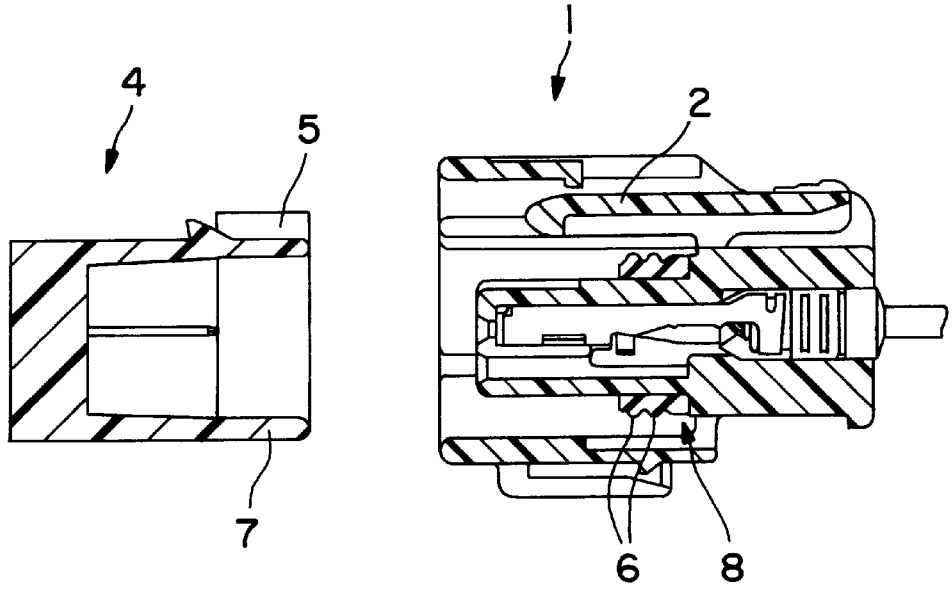
FIG. 9(B) PRIOR ART
Figure 10:
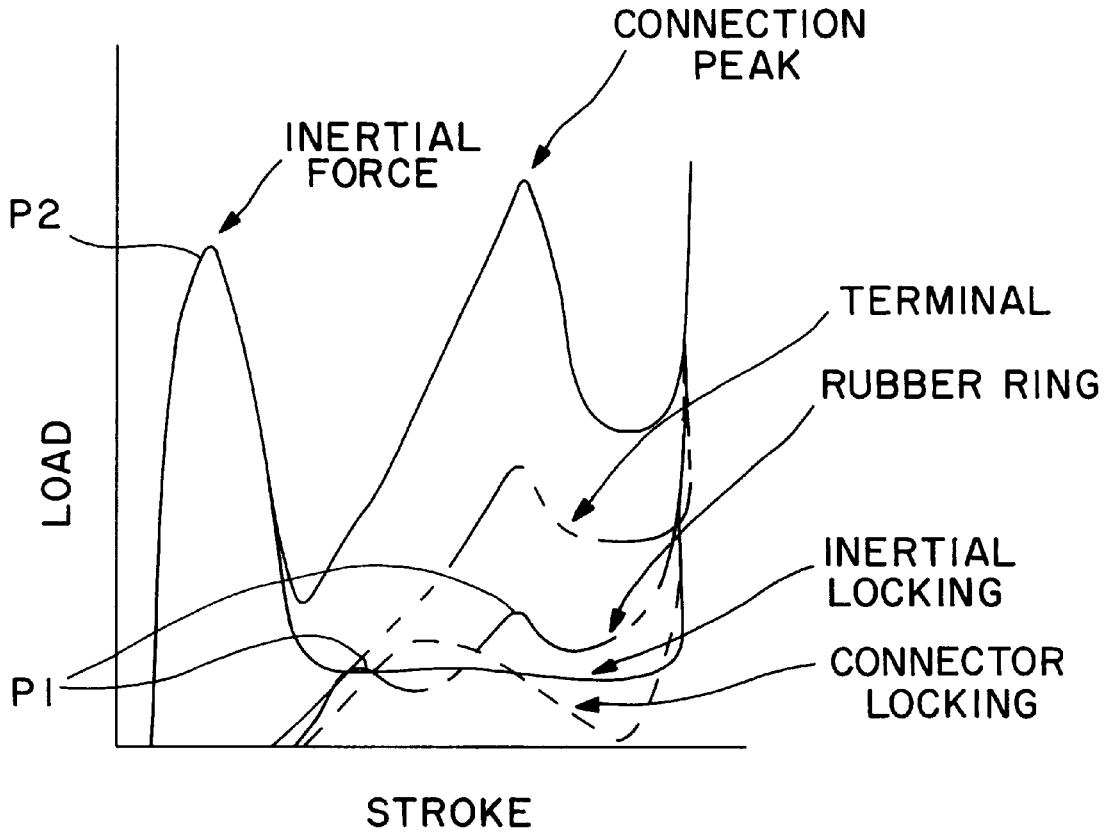
FIG. 10 PRIOR ART
FIG. 10 is a graph showing changes in connection resistances in the prior art watertight connector.

At the opposite sides of the lock arm 21, a pair of resistance arms 22 project forwardly substantially parallel to each other with the leading ends thereof hanging free as shown in FIG. 1. The resistance arms 22 and the contact ribs 15 construct an inertial locking mechanism 17 (a connection resistance generating means for temporarily generating a connection resistance or force larger than the connection resistances or forces by the waterproof ring and by the terminal fittings during the connecting operation). As an inertial locking mechanism according to a preferred embodiment of the present invention, one may use the inertial locking mechanism(s) disclosed in U.S. Pat. No. 5,830,002, U.S. Pat. No. 5,484,301 and/or U.S. Pat. No. 5,292,258. More specifically, one or more protuberances 30 laterally project preferably toward the lock arm 21 from the leading ends of the respective resistance arms 22. These protuberances 30 come into contact with the contact ribs 15 at or during an initial stage of the connecting operation of the housings 11, 20 (see FIG. 3). Contact surfaces 30A of the protuberances 30 with the ribs 15 are inclined at an angle preferably between 70° to 110, more preferably between 80° and 100 ° most preferably approximate to a right angle with respect to the connection direction CD. Accordingly, when a reaction force acting on the protuberances 30 from the ribs 15 in response to a force applied for the connection along the connection direction CD acts as pushing forces for deflecting the resistance arms 22 in respective deflection directions DD, DD' or lateral directions, preferably outward, the pushing forces in the deflecting directions DD, DD' can be suppressed at least to a high level or degree. When the contact surface 30A of the protuberances 30 of the resistance arms 22 substantially come into contact with the distal ends of the contact ribs 15, a restricting state of the inertial locking mechanism 17 is reached (FIG. 3). Thus, a considerably large connecting force is required to deflect the resistance arms 22 outward against their elastic forces. In this way, a large connection resistance is generated by the resistance arms 22. The degree of this connection resistance is preferably set larger than connection resistances which act between the male tab 13 and the female terminal fitting 23 and between the lock arm 21 and the lock projection 14, etc. Specifically, FIG. 8 shows changes in the connection resistance values of the respective elements as the housings 11, 20 are connected. Further, the dimensions of the respective members are preferably set such that the male tab 13 and the female terminal fitting 23 are not connected yet when the connection resistance by the resistance arms 22 is generated.

As shown in FIG. 2, a waterproof ring 27 is mounted around a base portion of the cavity 24. A pair of annular projections 28A, 28B are so formed on the outer circumferential surface of the waterproof ring 27 as to substantially circumferentially extend substantially in parallel to each other. These projections 28A, 28B are pushed and/or deformed by the inner surface of the receptacle 12 to hold a connection portion of the housings 11, 20 substantially watertight (see FIG. 6). The two annular projections 28A, 28B are spaced apart, and the front one (left one in FIG. 2) is so formed as to be brought into contact with the front end of the receptacle 12 (see FIG. 4) when the inertial locking mechanism 17 is in its restricting state or when the resistance arms 22 come into or are in contact with the contact ribs 15 (see FIG. 3) during the connection of the housings 11, 20. As enlargedly shown in FIG. 7, grooves 29 are formed at the base of the projections 28A, 28B so that the projections 28A, 28B can be easily deformed along the connection direction CD (a transverse direction of FIG. 7).

Next, an operation of connecting the housings 11, 20 and the action and effects of the present invention are described. The female housing 20 is pushed at least partially onto the male housing 11, while the surrounding wall 25 of the female housing 20 is fitted at least partially around the receptacle 12 of the male housing 11. Then, the protuberances 30 of the resistance arms 22 come into contact with the respective front ends of the ribs 15 preferably at the initial stage of the connecting operation, thereby generating the connection resistance. At substantially this time, the front annular projection 28A of the waterproof ring 27 comes into contact with the leading end of the receptacle 12 in the watertight connector of this embodiment. Thus, as shown in FIG. 8, one of the peaks (P3 in FIG. 8) of the connection resistance value of the waterproof ring 27 and a peak (P4 in FIG. 8) of the connection resistance value of the inertial locking mechanism 17 (substantially corresponding to the restricting state thereof) are reached at substantially the same time, with the result that the connecting operation of the housings 11, 20 are restricted by a resulting large connection resistance.

The resistance arms 22 are deflected substantially elastically outwardly to disengage the protuberances 30 thereof from the ribs 15 when the force to push the female housing 20 onto the male housing 11 is strengthened to exceed a connection resistance value which is a sum of the connection resistance by the inertial locking mechanism 17 and the one by the annular projection 28A at a given stroke (or insertion depth of the male connector housing 11 into the female connector housing 20 or mating length of the two connector housings 11, 20). At this time, since the large connection resistance which is a sum of the peaks of the connection resistance values of the inertial locking mechanism 17 and the annular projection 28A is suddenly cancelled or strongly decreased, a change in the connection resistance is made clearer than in the prior art connector. Therefore, an operator can more clearly feel and notice that the inertial locking function has been displayed. The housings 11, 20 reach their properly connected state at a predetermined or predeterminable stroke by the pushing force, and the lock arm 21 and the lock projection 14 are engaged to lock the housings 11, 20 so as not to be disengaged from each other. At this time, connection resistances also act, for example, between the lock arm 21 and the lock projection 14, between the male tab 13 and the female terminal fitting 23 and between the rear annular projection 28B and the receptacle 12. However, since the pushing force exceeding the sum of the peaks of the connection resistance values of the inertial locking mechanism 17 and the front and/or rear annular projection 28A, 28B is large, the housings 11, 20 are properly connected without problems.

According to the watertight connector of this embodiment, a large connection resistance is generated by substantially synchronizing the timings of the peak of the connection resistance value of the waterproof ring 27 and that by the inertial locking mechanism 17. Therefore, a difference between the connection resistance value during the connection restriction by the inertial locking mechanism 17 and the one after the cancellation of the connection restriction is made clearer. As a result, the operator can connect the housings 11, 20 while sufficiently feeling and noticing a success in connecting them.

The present invention is not limited to the described and illustrated embodiment but, for example, the following embodiments are also embraced by the technical scope of the present invention as defined in the claims. Besides the following embodiments, a variety of other changes can be made without departing from the scope and spirit of the invention as defined in the claims.

The present invention may be applied to a watertight connector in which a waterproof ring has one, three or more annular projections.

The resistance arm 22 may be provided only at either one of left and right sides of the lock arm 21.

Instead of an annular projection 28A also one or more non-annular projections (e.g. circumferentially distributed short projections) may be provided on the waterproof ring 27, wherein the watertightness is ensured by a portion of the waterproof ring 27 different from the above mentioned projections, e.g. by a cylindrical portion thereof and/or by other annular projections.

The watertight connector was described with reference to one single female connector housing and one single male connector housing. However, the invention may also be applied to a female connector housing being capable of housing two or more male connector housings or vice versa.

What is claimed is:

1. A watertight connector assembly, comprising:

a first connector housing;

a first terminal fitting mounted in the first connector housing;

a second connector housing mateable with the first connector housing;

an inertial locking mechanism located on at least one of said connector housings for generating a first connection resistance during mating;

a waterproof ring disposed for engagement between the first and second connector housings, the waterproof ring having front and rear projections spaced axially from one another along a mating direction of said first and second connector housings, said front projection providing a second connection resistance during mating of the housings, and the rear projection providing a third connection resistance during the mating of the housings;

a second terminal fitting mounted in the second connector housing, the second terminal fitting being disposed for electrical connection with the first terminal fitting in response to the mating of the first and second connector housings and for generating a fourth connection resistance; and wherein the projections of the waterproof ring are disposed such that the second connection resistance generated by the front projection occurs substantially simultaneously with the first connection resistance generated by the inertial locking mechanism, and such that the third connection resistance generated by the rear projection and the fourth connection resistance generated by the terminal fittings do not occur simultaneously and occur after the first and second connection resistances.

2. A watertight connector assembly according to claim 1, wherein the inertial locking mechanism is configured to substantially cancel the first connection resistance before the rear projection on the waterproof ring and the second terminal fitting generate the third and fourth connection resistances respectively.

3. The watertight connector assembly of claim 1, wherein the waterproof ring is mounted around a portion of the first connector housing, the second connector housing including a generally tubular portion for telescoping over the waterproof ring as the first and second connector housings are mated.

4. The waterproof connector assembly of claim 1, wherein the inertial locking mechanism comprises at least one contact rib formed on the second connector housing and at least one resiliently deflectable resistance arm at a location on the first connector housing for engagement with the contact rib during the mating of the first and second connector housings, the resistance arm being deflectable in response to pushing forces on the first and second connector housings for urging the first and second connector housings into the mated condition.

5. The watertight connector assembly of claim 4, wherein the resistance arm is provided with at least one protuberance with a contact surface aligned at an angle between approximately 70° and 110° relative to a mating direction of the first and second connector housings.

6. The waterproof connector assembly of claim 5, wherein the contact surfaces are aligned to the connecting direction at an angle between 80° and 100°.

7. The connector assembly of claim 6, wherein the contact surface of the resistance arm is aligned substantially at a right angle to the connection direction.

* * * * *